US006170182B1

(12) United States Patent
Skypala

(10) Patent No.: US 6,170,182 B1
(45) Date of Patent: Jan. 9, 2001

(54) NAUTICAL CHART HOLDER ARRANGEMENT

(76) Inventor: Robert J. Skypala, 5 Cherry Lawn La., Northport, NY (US) 11768

( * ) Notice: Under 35 U.S.C. 154(b), the term of this patent shall be extended for 0 days.

(21) Appl. No.: 08/842,338

(22) Filed: Apr. 24, 1997

Related U.S. Application Data

(63) Continuation-in-part of application No. 08/634,762, filed on Apr. 19, 1996, now abandoned.

(51) Int. Cl.[7] ..... G09F 11/18
(52) U.S. Cl. ..... 40/514; 40/904
(58) Field of Search ..... 40/514, 515, 904

(56) References Cited

U.S. PATENT DOCUMENTS 948,506 * 2/1910 Horton ..... 40/514
4,026,485 * 5/1977 Ambrose ..... 40/514
4,525,946 * 7/1985 Olson ..... 40/514
5,074,409 * 12/1991 Elkin et al. ..... 206/6.1
5,452,508 * 9/1995 Wu ..... 29/428

* cited by examiner

*Primary Examiner*—Cassandra H. Davis
(74) *Attorney, Agent, or Firm*—Connolly Bove Lodge & Hutz LLP

(57) ABSTRACT

A chart holding arrangement is provided for nautical charts, wherein one end of the chart is secured to an elongated, hollow support and the other end is secured to a rigid strip. This allows the chart to be easily viewed in extended (flat) form in the absence of a flat surface to spread out the chart. After use, the chart is rolled around the support for safe storage.

7 Claims, 1 Drawing Sheet

NAUTICAL CHART HOLDER ARRANGEMENT

This application is a Continuation-In-Part of Ser. No. 08/634,762, filed Apr. 19, 1996, now abandoned.

FIELD OF THE INVENTION

The invention relates to a holder arrangement for charts and the like, and in particular, nautical charts.

BACKGROUND OF THE INVENTION

When navigating at sea, it is common to use large, detailed navigation charts, fishing charts, or the like. These charts can be several feet wide and several feet long, or larger, and can be cumbersome to use and store. It is necessary to keep the charts from being damaged in use or in storage.

Normally, charts are folded or rolled for storage. Recently, many large charts have been laminated with clear plastic on each side for protection. Lamination can make the charts difficult to roll up for storage.

Map holders of various types are known in the art and the following disclosures are exemplary: U.S. Pat. No. 928,060; U.S. Pat. No. 2,180,146; U.S. Pat. No. 3,533,177; and U.S. Pat. No. 5,359,797.

SUMMARY OF THE INVENTION

To address the problems which exist with paper and laminated charts and their convenient use and storage, it is an object of the present invention to provide a nautical chart in an easily-accessible, easily-stored arrangement which protects the chart from damage.

The invention comprises an elongated foam support means to which one edge of the chart is fixed. The chart is rolled up over the support means when not in use. At the opposite end of the chart from the support means is provided a rigid end strip. The support means and end strip together allow the chart to be grasped and maintained in unrolled form for use, holding the chart flat for viewing. For storage, the chart is rolled up around the support means and fastened in the rolled condition for secure storage.

DESCRIPTION OF THE DRAWING FIGURES

DESCRIPTION OF THE PREFERRED EMBODIMENTS

Figure 1:
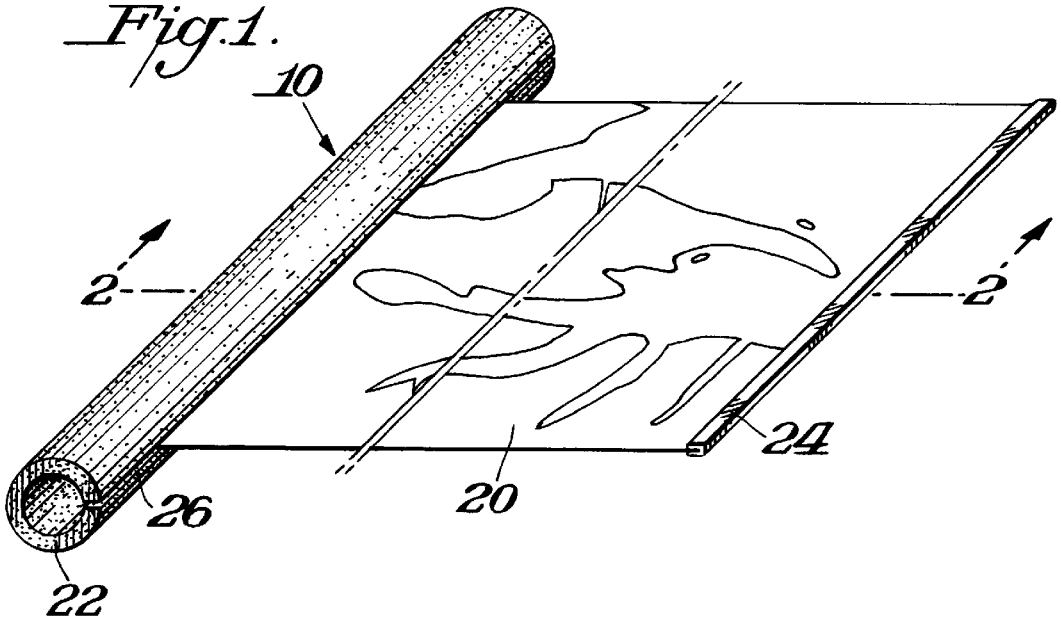
FIG. 1 is a perspective view of the chart holding arrangement wherein the chart is unrolled for viewing.

A preferred form of the chart arrangement of the invention is illustrated in perspective in FIG. 1.

The chart arrangement 10 includes a nautical chart 20, an elongated support means 22 to which one edge of the chart is affixed, and a rigid end strip 24 to which the opposite edge of the chart from the support means is attached.

The chart 20 may be a chart, map or any other type of information-bearing surface. The arrangement of the invention has been found to be particularly useful in a boating environment, where charts can be particularly difficult to use and store and are subjected to harsh conditions. Typically, such charts are composed of heavy paper. The paper may be laminated on one or both sides, provided the lamination does not prevent the chart from being rolled for storage, as described below. Weatherproof, tear-resistant paper is particularly preferred.

Figure 3:
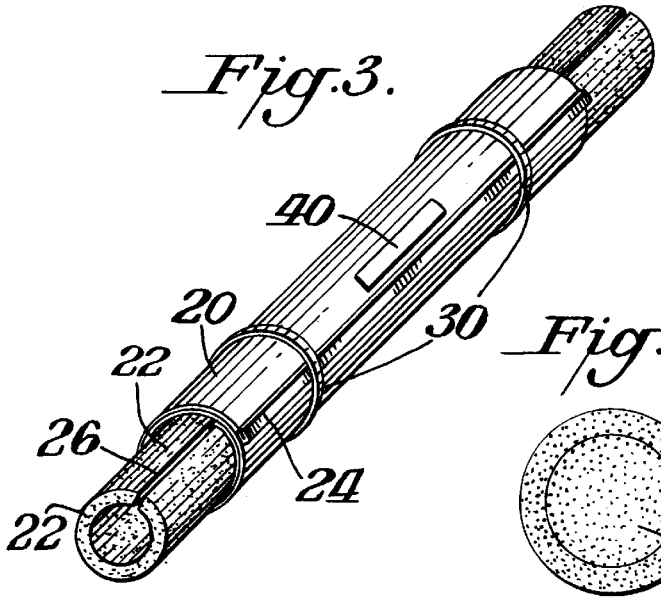
FIG. 3 is a perspective view of the chart arrangement wherein the chart is rolled up for storage.

The elongated support means 22 provides a support which secures one end of the chart and serves as a base around which the chart is rolled for storage. The support means is preferably in the form of a tube. As shown in FIGS. 1 and 3, the tube may be slightly longer than the edge of the chart.

Figure 2:
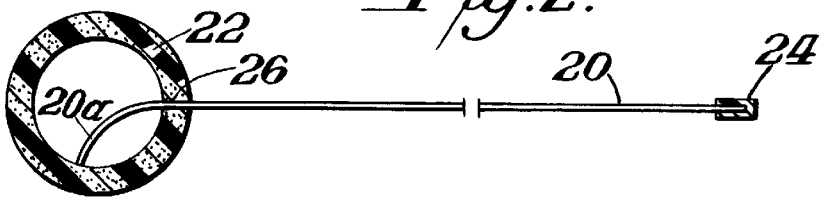
FIG. 2 is a cross-sectional end elevational view, partially broken away, taken along line 2—2 of FIG. 1.
Figure 5:
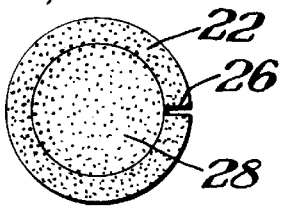
FIG. 5 is an end elevational view of an alternate embodiment wherein the support means is plugged rather than hollow.

To secure the chart to the support means, an elongated slot 26 is provided in the support means. One edge of the chart is inserted into the elongated slot. Secured end 20*a* of the chart can extend into the hollow core of the support means, as shown in FIG. 2. The chart may be secured to the support means by friction in the elongated slot, but preferably by adhesive or the like. Alternatively, the hollow core of the support means 22 can be plugged by plug 28 (FIG. 5). In the latter embodiment, the chart end 20*a* is securely held between the inner surface of the support and the plug filling the support.

The support means 22 is made of foam, to be lightweight and to float if dropped overboard. Preferably, the foam is pliant and flexible, allowing the entire arrangement to be bent during use in cramped spaces or during storage. As an exemplary material, foam pipe insulation is suitable. Attachment of the chart to light, flexible foam adds structure to the foam. Use of light, flexible foam also avoids sharp edges which could tear the chart, for example, if the chart is caught by a strong wind. Flexible foam is also forgiving; if the arrangement is accidentally jammed or stepped on, the arrangement is not damaged.

The rigid end strip 24, which is stiff but may be somewhat bendable, is securely affixed to the edge of the chart opposite to the support means. The rigid end strip is preferably plastic, wood or the like and is about the same length as the edge of the chart to which it is affixed.

The chart arrangement is shown in unrolled form in FIG. 2. To view the chart, one can grasp the support 22 in one hand and the edge strip 24 in the other hand. The chart can thus be easily maintained in a flat, distended position for viewing. The arrangement is particularly convenient where space is limited.

Figure 4:
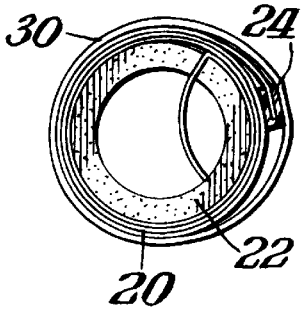
FIG. 4 is an end elevational view of the embodiment of FIG. 3.

After use, the chart is rolled around the support 22 for storage. See FIGS. 3 and 4. When fully rolled up, the chart is fastened in rolled up condition. For example, rubber bands 30 can be placed around the rolled up chart arrangement. Other fastening means such as hook and loop fastening could be used. An identification tag 40 could be placed on the chart to identify the chart without the need to unroll it.

A further advantage of the arrangement as disclosed is that no separate protective cover (backing layer) for the chart is required. Both sides of the chart may contain information and may be used when the chart is unrolled from the support.

From the foregoing, it can be appreciated that the chart arrangement of the invention facilitates the use of a large chart under conditions of limited space. After use, the chart is rolled around the support for safe storage.

What is claimed is:

1. A nautical chart holding arrangement for holding or storing a nautical chart, which allows for convenient viewing of the chart when extended, comprising:

a) a nautical chart bearing information on a surface thereof;

b) an elongated support means composed of flexible, pliant foam material to which a first edge of the chart is affixed;

c) an edge strip provided on a second edge of the chart opposite to the elongated support means;

whereby the elongated support means serves as a base around which the chart is rolled when not in use.

2. The chart holding arrangement of claim 1, wherein the support means comprises a hollow tube which is provided with an elongated slot into which one end of the chart is inserted to achieve secure affixing of the chart to the support means.

3. The chart holding arrangement of claim 2, wherein the hollow interior of the tube is plugged.

4. The chart holding arrangement of claim 1, wherein the chart is waterproof, tear-resistant paper.

5. The chart holding arrangement of claim 1, additionally comprising fastening means for securing the chart in rolled up form.

6. The chart holding arrangement of claim 1, wherein the chart is affixed to the foam by adhesive.

7. The chart holding arrangement of claim 1, wherein the nautical chart is not provided with a protective backing cover.

* * * * *